US009127605B2

(12) United States Patent
Plymale et al.

(10) Patent No.: US 9,127,605 B2
(45) Date of Patent: Sep. 8, 2015

(54) VAPOR RECOVERY SYSTEM PURGE VALVE AND METHOD

(75) Inventors: Kevin William Plymale, Canton, MI (US); Paul Zeng, Inkster, MI (US); Patrick Brostrom, Livonia, MI (US); Abdelkrim Zouani, Canton, MI (US); Ahsanul Karim, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 591 days.

(21) Appl. No.: 13/426,533

(22) Filed: Mar. 21, 2012

(65) Prior Publication Data

US 2013/0247880 A1 Sep. 26, 2013

(51) Int. Cl.

| | |
|---|---|
| ***F02M 33/04*** | (2006.01) |
| ***F02D 41/00*** | (2006.01) |
| ***F02M 25/08*** | (2006.01) |

(52) U.S. Cl.

CPC ..... *F02D 41/004* (2013.01); *F02M 25/0836* (2013.01)

(58) Field of Classification Search

CPC ..... F02D 41/004; F02D 41/0032; F02D 41/0042; F02M 33/04; F02M 25/08; F02M 25/0836; F02M 25/0809; F02M 25/0854; F02M 25/0872

USPC ..... 123/516, 518–521, 548–549, 572, 574; 251/129.21, 129.22, 129.15, 129.16, 251/129.5

See application file for complete search history.

(56) References Cited

U.S. PATENT DOCUMENTS

| | | | | |
|---|---|---|---|---|
| 3,985,300 | A * | 10/1976 | Pinney | 239/119 |
| 4,901,974 | A | 2/1990 | Cook et al. | |
| 5,018,703 | A | 5/1991 | Goode | |
| 5,277,167 | A | 1/1994 | DeLand et al. | |
| 5,413,082 | A | 5/1995 | Cook et al. | |
| 5,697,351 | A * | 12/1997 | Schumacher | 123/574 |
| 6,152,115 | A * | 11/2000 | Busato et al. | 123/520 |
| 6,548,837 | B1 * | 4/2003 | Vaz De Azevedo et al. | 251/129.21 |
| 6,739,204 | B1 * | 5/2004 | Barefoot | 73/861.32 |
| 6,739,573 | B1 | 5/2004 | Balsdon | |
| 6,968,923 | B2 | 11/2005 | Schmaeman | |
| 7,147,202 | B2 | 12/2006 | Schulz et al. | |
| 7,311,091 | B2 * | 12/2007 | Duprez | 123/574 |
| 7,401,751 | B2 * | 7/2008 | Holder | 244/129.5 |
| 7,409,947 | B2 | 8/2008 | Koyama | |
| 7,472,694 | B2 * | 1/2009 | King | 123/518 |
| 7,815,165 | B2 | 10/2010 | Okuda | |
| 7,913,504 | B2 * | 3/2011 | Lu et al. | 62/222 |
| 2002/0112702 | A1 * | 8/2002 | Weldon et al. | 123/520 |
| 2004/0050427 | A1 * | 3/2004 | Ryabtsev et al. | 137/541 |
| 2005/0029480 | A1 * | 2/2005 | Cook | 251/129.19 |
| 2005/0097880 | A1 * | 5/2005 | Jansen | 60/39.281 |
| 2006/0011174 | A1 * | 1/2006 | Perry et al. | 123/520 |
| 2007/0272217 | A1 * | 11/2007 | Kubota et al. | 123/495 |

(Continued)

*Primary Examiner* — John Kwon
*Assistant Examiner* — Johnny H Hoang
(74) *Attorney, Agent, or Firm* — James Dottavio; Alleman Hall McCoy Russell & Tuttle LLP

(57) ABSTRACT

A canister purge valve, fuel vapor recovery system, and method are provided. The canister purge valve may include an inlet port configured to be coupled with an inlet line to receive a fluid from a vapor-recovery canister. The canister purge valve may also include an outlet having two or more exit ports configured to be coupled with a common exit line to pass the fluid to an engine. In this way, improved mixing may be achieved without substantially increasing flow resistance and/or noise.

25 Claims, 6 Drawing Sheets

(56) References Cited

U.S. PATENT DOCUMENTS

2009/0013972 A1* 1/2009 Wilson et al. ..... 123/514
2009/0255516 A1* 10/2009 Matsumoto ..... 123/520
2010/0139625 A1* 6/2010 Vulkan et al. ..... 123/520
2010/0199954 A1* 8/2010 Inoue et al. ..... 123/521
2012/0199773 A1* 8/2012 Miura ..... 251/129.15

* cited by examiner

VAPOR RECOVERY SYSTEM PURGE VALVE AND METHOD

TECHNICAL FIELD

The present application relates to a system and a method for recovering fuel vapor in an engine system, and in particular a system and purge valve having a single inlet and two or more outlet exit ports configured to flow into a common exit line.

BACKGROUND AND SUMMARY

Vapor recovery systems are used in engines to capture fuel vapors, thereby reducing evaporative emission. Fuel vapor recovery canisters, commonly including vapor absorbing carbon, may be used to capture and store the fuel vapor during various times such as during refueling operations. Then, when the engine is running, the fuel vapors may be purged from the canister, and burned, by passing atmospheric air through the canister and into the engine combustion chamber. The air to purge the canister is controlled by a canister purge valve.

A problem exists with canister purge valves in that they can be noisy. One attempt to reduce canister purge valve noise is described in U.S. Pat. No. 6,739,573 to Balsdon. The disclosure attempts to dampen or attenuate undesired noise resulting from the opening and closing of the valve by providing an impact absorbing resilient member to absorb the impact of the valve on a valve seat.

The inventors of the present application have recognized a problem with the above solution. In particular the disclosed attempt does not address a significant contributor to canister purge valve noise. Existing canister purge valves create undesirable air flow noise when they operate. Research work and test data has shown that the air flow noise occurs as the valve opens and closes. The cause of the air noise is the abrupt air pressure change between the valve inlet and outlet as the valves cycles between open and closed. This sound wave travels from the valve outlet to the engine intake manifold.

The inventors herein have discovered a way to disrupt the sound wave as it travels to the intake manifold. Embodiments in accordance with the present disclosure provide a valve outlet design that may prevent the sound wave from traveling directly to the intake manifold. Embodiments may be utilized to break the outlet stream and related sound wave into smaller ones. In this way sound wave intensity may be significantly reduced.

Accordingly, in one example, some of the above issues may be addressed by providing a canister purge valve that may include an inlet port configured to be coupled with an inlet line to receive a fluid from a vapor-recovery canister; and an outlet having two or more exit ports configured to be coupled with a common exit line to pass the fluid to an engine.

In another example, some of the above issues may be addressed by providing a fuel vapor recovery system for an engine. The system may include: a vapor recovery canister arranged in fluidic communication with a fuel tank; an intake manifold in fluidic communication with an engine combustion chamber; and a purge valve configured to control a flow of fluid, the purge valve having an inlet coupled to the fuel tank and an outlet stem with two or more exit ports coupled into a single, common, outlet line leading to the intake manifold.

In still another example, some of the above issues may be addressed by providing a method of operating an engine vapor recovery system. The method may include: routing a purge gas from a canister through a valve to an engine intake manifold; the purge gas may exit the valve from two or more exit ports into a single purge line.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-4 are drawn approximately to scale, although other relative dimensions may be used, if desired

DETAILED DESCRIPTION

Figure 1:
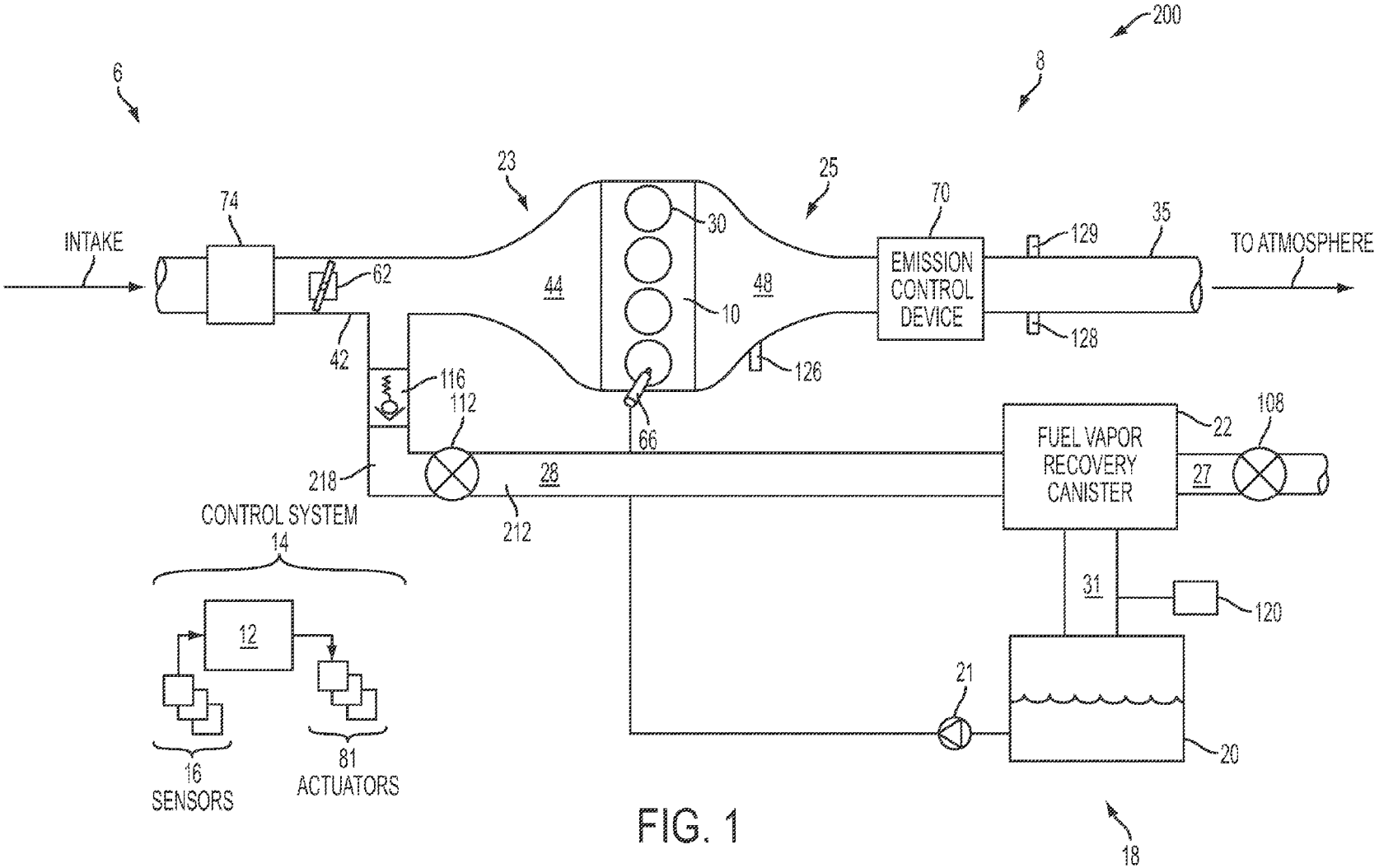
FIG. 1 illustrates a schematic depiction of an engine system including an example fuel vapor recovery system in accordance with the present disclosure.

FIG. 1 shows a schematic depiction of a vehicle system 6. The vehicle system 6 includes an engine system 8 coupled to a fuel vapor recovery system 200 and a fuel system 18. The engine system 8 may include an engine 10 having a plurality of cylinders having a respective plurality of combustion chambers 30. The engine 10 includes an engine intake 23 and an engine exhaust 25. The engine intake 23 includes a throttle 62 fluidly coupled to the engine intake manifold 44 via an intake passage 42. The engine exhaust 25 includes an exhaust manifold 48 leading to an exhaust passage 35 that routes exhaust gas to the atmosphere. The engine exhaust 25 may include one or more emission control devices 70, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors, as further elaborated in the example embodiments of FIGS. 2-6.

The engine intake 23 may further include a boosting device, such as a compressor 74. Compressor 74 may be configured to draw in intake air at atmospheric air pressure and boost it to a higher pressure. As such, the boosting device may be a compressor of a turbocharger, where the boosted air is introduced pre-throttle, or the compressor of a supercharger, where the throttle is positioned before the boosting device. Using the boosted intake air, a boosted engine operation may be performed.

Fuel system 18 may include a fuel tank 20 coupled to a fuel pump system 21. The fuel pump system 21 may include one or more pumps for pressurizing fuel delivered to the injectors of engine 10, such as the example injector 66 shown. While only a single injector 66 is shown, additional injectors are provided for each cylinder. It will be appreciated that fuel system 18 may be a return-less fuel system, a return fuel system, or various other types of fuel system. Vapors generated in fuel system 18 may be routed to a fuel vapor recovery system 200, described further below, via conduit 31, before being purged to the engine intake 23. Conduit 31 may optionally include a fuel tank isolation valve. Among other functions, fuel tank isolation valve may allow a fuel vapor canister 22 of the fuel vapor recovery system 200 to be maintained at a low pressure or vacuum without increasing the fuel evaporation rate from the tank (which would otherwise occur if the fuel tank pressure were lowered). The fuel tank 20 may hold a plurality of fuel blends, including fuel with a range of alcohol concentrations, such as various gasoline-ethanol blends, including E10, E85, gasoline, etc., and combinations thereof. A fuel tank pressure transducer (FTPT) 120, or fuel tank pressure sensor, may be included between the fuel tank 20 and fuel vapor canister 22, to provide an estimate of a fuel tank pressure, and for engine-off leak detection. The fuel tank pressure transducer may alternately be located in conduit 31, purge line 28, vent 27, or fuel vapor canister 22, without affecting its engine-off leak detection ability.

Fuel vapor recovery system 200 may include one or more fuel vapor recovery devices, such as one or more fuel vapor canisters 22 filled with an appropriate adsorbent, the canisters 22 may be configured to temporarily trap fuel vapors (including vaporized hydrocarbons) during fuel tank refilling operations and "running loss" (that is, fuel vaporized during vehicle operation). In one example, the adsorbent used may be activated charcoal. Fuel vapor recovery system 200 may further include a vent 27 which may route gases out of the recovery system 200 to the atmosphere when storing, or trapping, fuel vapors from fuel system 18. Vent 27 may also allow fresh air to be drawn into fuel vapor canister 22 when purging stored fuel vapors from fuel system 18 to engine intake 23 via purge line 28 and purge valve 112. A canister check valve 116 may also be included in purge line 28 to prevent (boosted) intake manifold pressure from flowing gases into the purge line in the reverse direction. While this example shows vent 27 communicating with fresh, unheated air, various modifications may also be used. Flow of air and vapors between fuel vapor recovery system 22 and the atmosphere may be regulated by the operation of a canister vent solenoid (not shown), coupled to canister vent valve 108. Further details of the fuel vapor recovery system 200, in particular details regarding purge valve 112, is described herein below with regard to FIGS. 2 and 3.

The vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, and pressure sensor 129. Other sensors such as pressure, temperature, air/fuel ratio, and composition sensors may be coupled to various locations in the vehicle system 6, as discussed in more detail herein. As another example, the actuators may include fuel injector 66, valve 29, and throttle 62. The control system 14 may include a controller 12. The controller may receive input data from the various sensors, process the input data, and trigger the actuators in response to the processed input data based on instruction or code programmed therein corresponding to one or more routines. Example control routines are described herein with regard to FIGS. 4-7.

Fuel vapor recovery system 200 may operate to store vaporized hydrocarbons (HCs) from fuel system 18. Under some operating conditions, such as during refueling, fuel vapors present in the fuel tank may be displaced when liquid is added to the tank. The displaced air and/or fuel vapors may be routed from the fuel tank 20 to the fuel vapor canister 22, and then to the atmosphere through vent 27. In this way, an increased amount of vaporized HCs may be stored in fuel vapor canister 22. During a later engine operation, the stored vapors may be released back into the incoming air charge using the intake manifold vacuum. Specifically, the fuel vapor recovery system 22 may draw fresh air through vent 27 and purge stored HCs into the engine intake for combustion in the engine. Such purging operation may occur during selected engine operating conditions as described herein.

Fuel vapor recovery system 200 may include one or more fuel vapor retaining devices, such as one or more of a fuel vapor canister 22. Canister 22 may be filled with an adsorbent capable of binding large quantities of vaporized HCs. In one example, the adsorbent used is activated charcoal. Canister 22 may receive fuel vapors from fuel tank 20 through conduit 31. While the depicted example shows a single canister, it will be appreciated that in alternate embodiments, a plurality of such canisters may be connected together.

A tank isolation valve (not shown) may optionally be placed in conduit 31 to temporarily prevent fuel vapor pressure from transmitting itself to the rest of fuel vapor control system. In one example, the tank isolation valve may be mounted on the fuel tank. In another example, as depicted herein, the tank isolation valve may be coupled to the fuel tank along conduit 31. As such, optional tank isolation valve 205 may prevent vapor flow to fuel vapor canister 202, thereby reducing evaporation of fuel in the tank. Thus, in the absence of tank isolation valve, fuel tank 20 may be exposed to low intake manifold pressures that can accelerate vapor generation. Additionally, canister purging may be most effective with the tank isolated from the canister.

Figure 2:
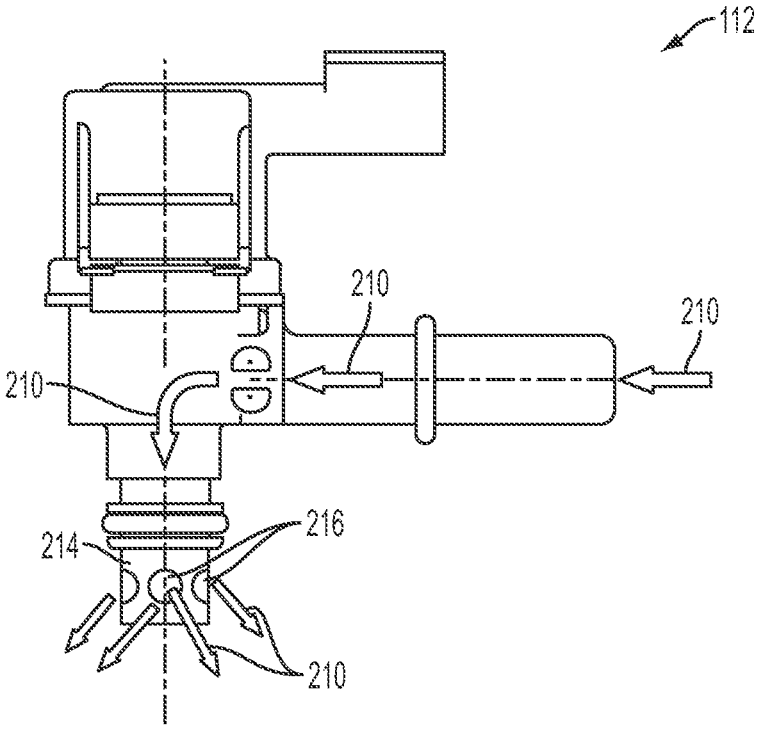
FIG. 2 is a front view illustrating an example a purge valve in accordance with the present disclosure that may be utilized with the fuel vapor recovery system illustrated in FIG. 1.

Referring still to FIG. 1 wherein an example embodiment of a fuel vapor recovery system 200 for an engine 8 is illustrated, and also to FIG. 2 wherein details of an example purge valve 112, which may be included in system 200, is illustrated. The fuel vapor recovery system 200 may include a vapor recovery canister 22 arranged in fluidic communication with a fuel tank 20. The fuel vapor recovery system 200 may also include an intake manifold 23 in fluidic communication with an engine combustion chamber 30. A purge valve 112 may be configured to control a flow of fluid represented with arrows 210 in FIG. 2. The purge valve 112 may have an inlet 212 coupled to the fuel tank 20. The system 200 may also include an outlet stem 214 with two or more outlet exit ports 216 coupled into a single, common, outlet line 218 (FIG. 2) leading to the intake manifold 23.

Figure 3:
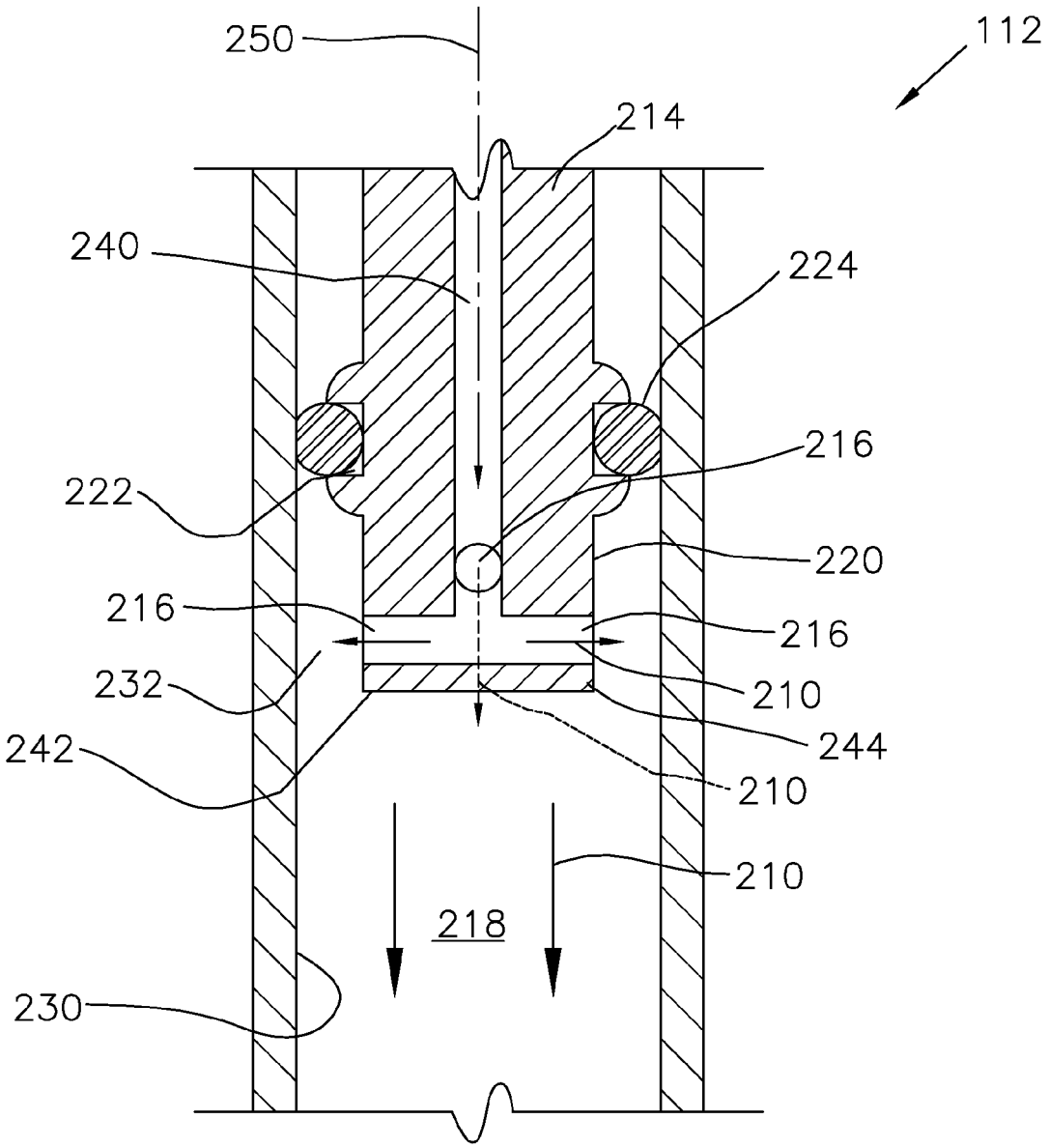
FIG. 3 is a partial cross sectional view illustrating alternate downstream details of another example purge valve in accordance with the present disclosure.

FIG. 3 is a partial cross sectional view illustrating alternate downstream details of another example purge valve 112 in accordance with the present disclosure. The purge valve 112 may be canister purge valve 112 which may be configured to include an inlet port (FIGS. 1 & 2) configured to be coupled with an inlet line to receive a fluid from a vapor-recovery canister 22 (FIG. 1). The canister purge valve 112 may also include an outlet 214 having two or more exit ports 216 configured to be coupled with a common exit line 218 to pass the fluid to an engine 8. The common exit line 218 may lead to the intake manifold 23 of the engine 8. Example fluids may include gases and vapors that may originate, for example, from the gas tank 20.

In some embodiments the two or more exit ports 216 may be three, or four, or more exit ports, the canister purge valve may be a valve of a fuel vapor recovery system of the engine. The exit ports 216 may be arranged radially on the outlet. In some cases the exit ports may be substantially evenly spaced. For example, three exit ports may be arranged at substantially 120 deg apart; four exit ports may be arranged at substantially 90 deg increments; five at 72 deg etc. The bottom of the outlet stem 214 may be sealed with, for example an end wall 244 such that the only exit ports are on the cylindrical sides of the outlet stem 214.

In some embodiments the exit ports 216 may be arranged in a preselected distribution determined by, for example, a mathematical function or the like. For example, the exit ports 216 may be arranged in a Gaussian distribution or another type of known distribution. In the case of exit ports 216 being arranged in a Gaussian distribution an outlet stem 214 may include, for example, nine holes that may be equally placed around the circumference of the outlet stem 214, but the distance of each exit port from a preselected center of the distribution, if plotted on a graph verses the number of exit ports at that distance, may approximate a Gaussian distribution. As mentioned other alternate distributions may be similarly plotted.

With some embodiments the exit ports may be randomly located on the outlet stem 214. The distance of each exit port 216 from a preselected location may be determined randomly by, for example, using a random number generator and the like. Random distribution, or other distribution patterns described herein, may be applied to circumferential location or longitudinal location of the exit ports on the outlet stem 214.

Some embodiments may be configured to cause at least some of the sound that may be generated by the valve 112 to be cancelled out through predetermined sizing and shaping of the outlet stem 214. For example, sound may bounce off the end wall 244 and back toward the incoming, or downstream moving, sound wave. The bounced sound wave may interfere with the incoming wave such that destructive interference may occur. In addition, or alternatively, with some embodiments the exit ports may be located at areas of minimal sound intensity. In this way the most intense portions of the sound waves may be muffled inside the valve while only the least intense components of the sound may exit the valve through the exit ports.

Some embodiments may be configured such that various parts of the valve and the valve as a whole are constructed to break up and/or prevent particular structural resonance of the valve, the valve components and/or the fluid passing through the valve. For example the valve and parts of the valve may be constructed to be significantly rigid, or significantly resilient, such that the valve and valve parts have a natural frequency of vibration that is sufficiently different than essentially any frequency of vibration that may be caused by the valve actuation, or the fluid passing through the valve. The "tuning" of the natural frequency may be at least partially accomplished by the size and/or placement and/or number of exit ports included in the valve.

In some embodiments the outlet stem 214 may be substantially cylindrical. In other embodiments the outlet stem may be shaped differently. The two or more outlets 216 may exit from a cylindrical surface 220 of the substantially cylindrical outlet stem 214.

The valve 112 of the fuel vapor recovery system 200 may include a circumferential seal 224 configured to contact an inner surface 230 of the outlet line 218 upstream from the outlet exit ports 216. A clearance 232 may be defined between the inner surface 230 and a portion of the valve downstream from the seal 224. The seal 224 may be a gasket 224 positioned upstream of the two or more exit ports 216. The gasket may be in contact with the inner wall 230 of the exit line 218. The seal 224 may be an O-ring 224 seated in an O-ring seat 222 formed on the outlet stem located upstream from the two or more exit ports 216 configured to seat an O-ring 224 to provide a sealing engagement 226 between the exit line 218 and the valve 112. The outer diameter of the O-ring 224 may be sufficiently larger than an outer diameter of the outlet stem 214 to provide the clearance 232 to allow for the flow of vapor to flow out of the exit ports 216, past the end of the valve, and into the common exit line 218.

FIG. 3 also illustrates an example embodiment wherein the outlet stem 214 may have a substantially centrally located bore 240 in fluidic communication with the inlet port 212. The bore 240 may be closed at a downstream end 242 thereof. The bore 240 may be closed with an end wall 244. The two or more exit ports 216 may be in fluidic communication with the bore 240. The bore 240 may fluidically couple the inlet port 212 to the exit ports 216. As illustrated, a first exit port may be offset in a direction of flow along the bore as compared to a second exit port. In some examples, each exit port is of in the flow direction from every other exit port. In other examples, a first pair of exit ports are positioned at the same location in the flow direction, but offset from a second pair of exit ports, also at the same location, in the flow direction. Further, the first pair of exit ports may be positioned on opposite sides of the cylindrical surface 220 from each other, as can the second pair of exit ports, with the first and second pair of exit ports approximately 90 degrees from one another around the axis 250. In another example, some exit ports may be positioned closer to the seal 224 than other exit ports. Further, some exit ports may be positioned closer to the closed end 244 than other exit ports. Further still, a diameter of the bore may be varied upstream of the furthest upstream exit port as compared to downstream of the furthest upstream exit port, in that the bore may have a smaller diameter in the downstream area as compared to the upstream area to provide more even flow rate distribution among the exit ports. In some example, there are no exit ports upstream of the seal 224. Further, in some cases the bore 240 may be offset in the outlet stem 214.

As specifically illustrated in FIG. 3, with some embodiments at least one exit port may be offset longitudinally from at least one other exit port. The example illustrated shows a first two exit ports 216 exiting to the right and to the left of a central axis 250 as shown on the page, and a second two exit ports 216 exiting into and out of the page above the first two exit ports 216. In some examples every other of the four outlet exit ports 216 may be arranged offset longitudinally from one another. In some examples every other of the four exit ports are longitudinally offset relative to a nearest exit port 216. In some cases they may all be at the same longitudinal position on the outlet stem. In some cases they may be offset in various ways.

Figure 4:
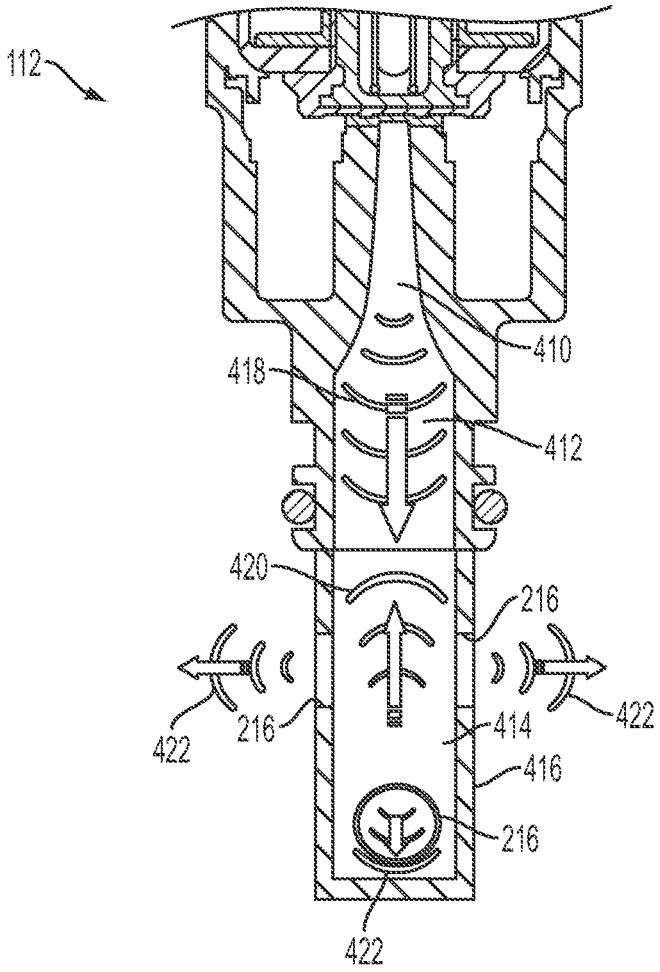
FIG. 4 is a partial cross sectional view illustrating another example purge valve in accordance with the present disclosure.

FIG. 4 is a partial cross sectional view illustrating another example purge valve 112 in accordance with the present disclosure. The purge valve 112 may include a central bore 240 that may include a first portion 410 with a variable inner diameter that flairs in the downstream direction and which opens into a wider second portion 412. The second portion 412 may lead into a relatively large cavity 414 defined by a relatively thin stem casing 416. An incoming sound wave sound wave 418 is illustrated with a series of arcs moving in a downstream direction. A bounced sound wave 420 is illustrated with a series of arcs moving in an upstream direction. Relatively smaller exiting sound waves 422 are illustrated with a series of relatively smaller arcs shown leaving exit ports 216 to illustrate relatively less intense sound.

In various embodiments the two or more exit ports 216 may exit the valve 112 in directions substantially perpendicular to the central axis 250 of the valve 112. In other cases the exit ports 216 may exit the valve 112 in various directions. In some cases one or more ports may exit the valve 112 in directions substantially perpendicular to a central axis 240 of the valve 112, wherein other of the one or more exit ports 216 may exit the valve 112 in directions that are not perpendicular to a central axis 240.

One embodiment may provide a fuel vapor recovery system 200 wherein the outlet stem 214 may be substantially cylindrical. The two or more exit ports 216 may be four exit ports 216 exiting radially from a cylindrical surface 220 of the outlet stem 214. The four exit ports 216 may be arranged at approximately 90 deg increments on the cylindrical wall 220, and two of the four exit ports 216 may be longitudinally offset relative to another two of the four exit ports 216.

Figure 5:
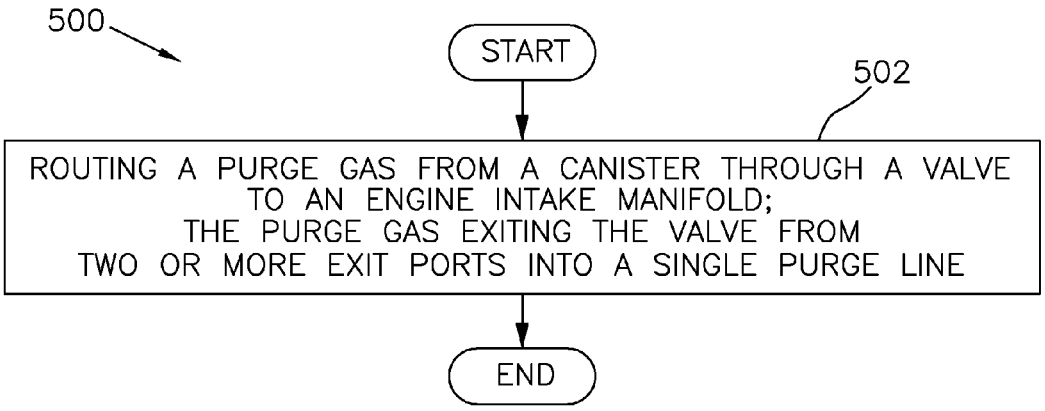
FIG. 5 is a flow diagram illustrating an example method of operating the fuel vapor recovery system in accordance with the present disclosure.

FIG. 5 is a flow diagram illustrating an example method of operating an engine vapor recovery system 500. The method 500, may include, at 502, routing a purge gas from a canister through a valve to an engine intake manifold; the purge gas exiting the valve from two or more exit ports into a single purge line. The single purge line may lead to an intake manifold. The two or more exit ports may direct the purge gas from the valve in two or more directions that are different from one another. The two or more directions may include directions that are differently radially positioned as compared to a central axis of the valve.

Figure 6:
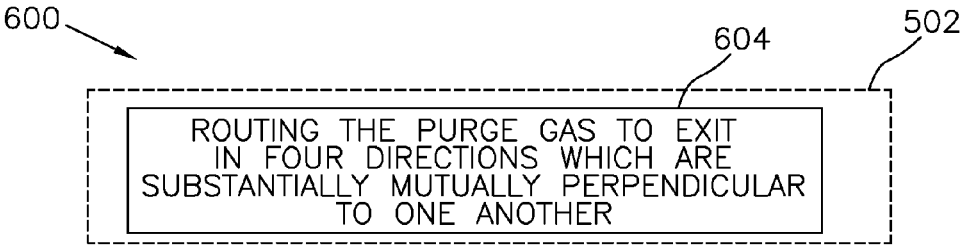
FIG. 6 is a flow diagram illustrating an example modification of the method illustrated in FIG. 5.

FIG. 6 is a flow diagram illustrating an example modification of the method 500 illustrated in FIG. 5. The method 500 may be modified wherein the routing the purge gas from the canister through the valve, 502, may include, at 604, routing the purge gas to exit in four directions which are substantially mutually perpendicular to one another.

Figure 7:
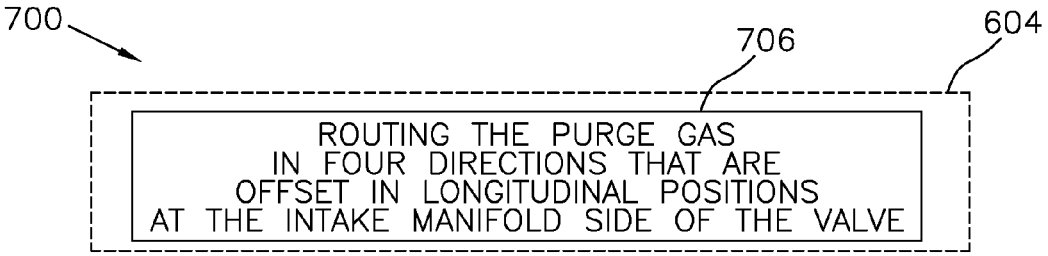
FIG. 7 is a flow diagram illustrating an example modification of the method illustrated in FIG. 6.

FIG. 7 is a flow diagram illustrating an example modification of the method 600 illustrated in FIG. 6. The method, 600, may be modified wherein the routing the purge gas in the four directions, 604, may include, at 706, routing the purge gas in four directions that are offset in longitudinal positions along the intake manifold side of the valve.

Figure 8:
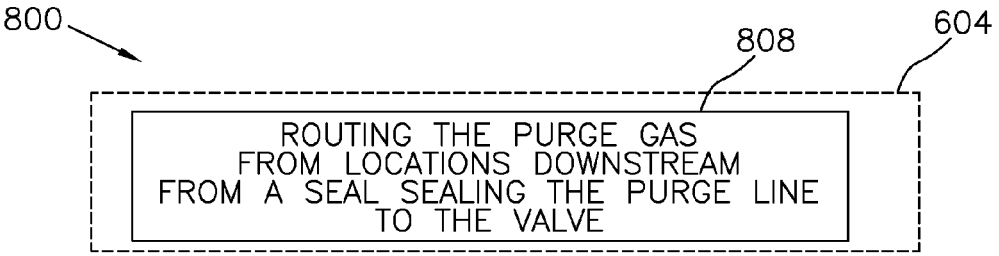
FIG. 8 is a flow diagram illustrating another example modification of the method illustrated in FIG. 6.

FIG. 8 is a flow diagram illustrating an example modification of the method 600 illustrated in FIG. 6. The method 600 may be modified wherein the routing the purge gas in the four directions, 604, may includes, at 808, routing the purge gas from locations downstream from a seal sealing the purge line to the valve.

The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system Further still, it should be understood that the systems and methods described herein are exemplary in nature, and that these specific embodiments or examples are not to be considered in a limiting sense, because numerous variations are contemplated. For example, the above technology can be applied to V-6, I-4, I-6, V-12, opposed 4, and other engine types. Accordingly, the present disclosure includes all novel and non-obvious combinations of the various systems and methods disclosed herein, as well as any and all equivalents thereof.

The invention claimed is:

1. A canister purge valve, comprising:

an inlet port configured to be coupled with an inlet line to receive a fluid from a vapor-recovery canister;

an outlet stem having exit ports arranged radially on the outlet, where at least one exit port is longitudinally offset from at least one other exit port;

a common exit line; and a seal in sealing engagement between the outlet stem and the exit line forming a clearance between an exit line inner surface and the outlet stem to allow flow out of the exit ports.

2. The canister purge valve of claim 1, wherein the exit ports are four exit ports, the canister purge valve being a valve of a fuel vapor recovery system of the engine.

3. The canister purge valve of claim 2, wherein four of the exit ports are arranged radially on the outlet stem, and wherein the four exit ports are positioned to be coupled to the common exit line leading to an intake manifold of the engine.

4. The canister purge valve of claim 1, further comprising the outlet stem on a downstream side of the valve having a substantially centrally located bore in fluidic communication with the inlet port, the bore being closed at a downstream end thereof, and wherein the exit ports are in fluidic communication with the bore.

5. The canister purge valve of claim 1, wherein the two or more exit ports are randomly located on the outlet stem.

6. The canister purge valve of claim 1, wherein the two or more exit ports are arranged on the outlet stem in a Gaussian distribution centered about a predetermined location on the outlet stem wherein the distance of each exit port from a preselected center of the distribution, if plotted on a graph versus the number of exit ports at the respective distance, approximates a Gaussian distribution.

7. The canister purge valve of claim 1, further comprising a cavity configured such that at least some of a downstream moving sound wave experiences destructive interference with a sound wave that has bounced off an end wall.

8. The canister purge valve of claim 1, wherein the valve and parts of the valve are constructed to break up and/or prevent particular structural resonance of the valve, the valve components and/or the fluid passing through the valve.

9. The canister purge valve of claim 1, wherein the two or more exit ports exit from a cylindrical surface of a substantially cylindrical outlet stem.

10. The canister purge valve of claim 1, further comprising an O-ring seat located upstream from the exit ports configured to seat an O-ring to provide the seal and form a sealing engagement between the exit line and the valve.

11. The canister purge valve of claim 1, wherein the seal comprises a gasket, the gasket in contact with an inner wall of the common exit line.

12. The canister purge valve of claim 1, wherein the exit ports exit the valve in directions substantially perpendicular to a central axis of the valve.

13. A fuel vapor recovery system for an engine comprising:

a vapor recovery canister arranged in fluidic communication with a fuel tank;

an intake manifold in fluidic communication with an engine combustion chamber; and a purge valve configured to control a flow of fluid, the purge valve having an inlet coupled to the fuel tank, an outlet stem with two or more exit ports arranged radially and longitudinally offset from one another on the outlet, the outlet stem coupled into a single, common, outlet line leading to the intake manifold, and a seal in sealing engagement between the outlet stem and the outlet line forming a clearance between an outlet line inner surface and the outlet stem to allow flow out of the exit ports and into the common outlet line, the clearance positioned downstream of the seal.

14. The fuel vapor recovery system of claim 13, wherein the outlet stem is substantially cylindrical and wherein the two or more exit ports exit from a cylindrical surface of the outlet stem.

15. The fuel vapor recovery system of claim 14, wherein the outlet stem includes a substantially centrally located bore to fluidically couple the inlet to the exit ports, and wherein the outlet stem includes a substantially centrally located bore in fluidic communication with the inlet port, the bore being closed at a downstream side of the outlet stem.

16. The fuel vapor recovery system of claim 13, wherein the two or more exit ports exit from a cylindrical surface of a substantially cylindrical stem and include exactly four exit ports arranged at substantially 90deg increments thereof.

17. The fuel vapor recovery system of claim 16, wherein every other of the four exit ports is arranged offset longitudinally from one another.

18. The fuel vapor recovery system of claim 13, wherein the outlet stem is substantially cylindrical, and wherein the two or more exit ports are four exit ports exiting radially from a cylindrical surface of the outlet stem, and wherein the four exit ports are arranged at approximately 90deg increments on a cylindrical wall of the outlet stem and wherein two of the four exit ports are longitudinally offset relative to another two of the four exit ports.

19. The fuel vapor recovery system of claim 18, wherein every other of the four exit ports are longitudinally offset relative to a nearest exit port.

20. The fuel vapor recovery system of claim 13, wherein the seal includes a circumferential seal contacting the inner surface of the outlet line only upstream from the exit ports.

21. The fuel vapor recovery system of claim 20, wherein the seal is an O-ring seated in an O-ring seat formed on the outlet stem.

22. A method of operating an engine vapor recovery system, comprising:

routing a purge gas from a canister through a valve to an engine intake manifold; the purge gas exiting the valve via an outlet stem projecting into a single purge line, the purge gas exiting the outlet stem from two or more exit ports radially arranged, and lon gitudinally offset from one another, on the outlet stem into a clearance formed by a seal in sealing contact between each of an outer surface of the outlet stem and a purge line inner surface.

23. The method of claim 22, wherein the two or more exit ports direct the purge gas from the valve in two or more directions that are different from one another.

24. The method of claim 23, wherein the two or more directions include directions that are differently radially positioned as compared to a central axis of the valve.

25. The method of claim 22, wherein the routing the purge gas from the canister through the valve includes routing the purge gas to exit in four directions which are substantially mutually perpendicular to one another, wherein the routing the purge gas in the four directions includes routing the purge gas in four directions that are offset in longitudinal positions at the intake manifold side of the valve, and wherein routing the purge gas includes routing the purge gas from locations downstream from the seal sealing the purge line to the valve.

* * * * *